US006705748B2

(12) United States Patent
Morris

(10) Patent No.: US 6,705,748 B2
(45) Date of Patent: Mar. 16, 2004

(54) LAMP WITH CERAMIC LIGHT SHIELD

(75) Inventor: Merle E. Morris, Lexington, KY (US)

(73) Assignee: Osram Sylvania Inc., Danvers, MA (US)

( * ) Notice: Subject to any disclaimer, the term of this patent is extended or adjusted under 35 U.S.C. 154(b) by 16 days.

(21) Appl. No.: 10/120,980

(22) Filed: Apr. 11, 2002

(65) Prior Publication Data

US 2003/0193806 A1 Oct. 16, 2003

(51) Int. Cl.[7] ..... F21V 7/00

(52) U.S. Cl. ..... 362/310; 362/296; 362/226; 362/329; 313/318.11

(58) Field of Search ..... 362/226, 296, 362/310, 329, 353; 313/318.11, 113

(56) References Cited

U.S. PATENT DOCUMENTS 4,829,210 A * 5/1989 Benson et al. ..... 313/113
5,548,182 A * 8/1996 Bunk et al. ..... 313/113

* cited by examiner

*Primary Examiner*—Sandra O'Shea
*Assistant Examiner*—Bao Q. Truong
(74) *Attorney, Agent, or Firm*—William E. Meyer

(57) ABSTRACT

A ceramic cup may be fitted in the neck of a reflector region to provide good reflection or blockage of the light incident on the reflector neck. Light is then prevented light from incorrectly exiting through the lamp neck or from heating the neck region. The ceramic cup can be cheaper than coatings or other shields. The ceramic cup shield can be more durable and electrically more compatible with the lead structure extending through the neck region. The cup shield can also help align and properly position the light source.

10 Claims, 2 Drawing Sheets

LAMP WITH CERAMIC LIGHT SHIELD

TECHNICAL FIELD

The invention relates to electric lamps and particularly to electric lamps with integral reflectors. More particularly the invention is concerned with an electric lamp with an integral reflector and a light shield.

BACKGROUND ART

Reflector lamps are commonly coated to reflect light forward. It can be difficult to adequately coat the neck region of the reflector to block light from exiting incorrectly through the neck, or to adequately shield the neck region from heat. As a result, light can shine through the neck, which may be unaesthetic or even unacceptable in display lighting applications. Similarly the light, including infrared heat, may shine into the socket region causing an undesirable or unacceptable heating of the lamp base, and socket region. To prevent such transmission, the neck regions of lamps have been coated with reflective material. This is reasonably functional in larger volume lamps where the neck is sufficiently open to receive the metal vapor. In smaller lamps good metallization in the small neck region is difficult to achieve. In dichriocally coated lamps, the multiple coatings are even more difficult to apply accurately. An alternative blocking method is to insert a metal shield in the neck region. Metal shields work well in larger lamps. Metal shields do have the problem of darkening with repeated heating. For example, nickel, steel and stainless steel shields, commonly darken. This darkening reduces the amount of reflected light, and enhances heat absorption and therefore retransmission of heat into the neck and socket region. The lost light is one detriment. The darkening can also be unaesthetic in display lighting where the original high quality lamp color (dichrioc or silvered) is expected as part of the jeweled display pattern. Aged, and variably discolored lamps are then felt to detract from the display. Heating the socket and seal regions can have other problems. Metal shields also provide conduction paths that at times can short circuit the lamp leads. This is a particularly difficult aspect of shielding small volume lamps were the leads are close together, and there is little surrounding volume to contain the metal shield. There is then a need for a small volume reflector lamp that does not project light into or through the base region, does not discolor and does not short circuit the lamp leads.

DISCLOSURE OF THE INVENTION

A reflector lamp may be made with a glass shell having an interior surface extending from a reflector region that defines a reflector cavity to a neck region that defines a neck cavity. Positioned in the reflector and neck cavity regions is a light source offset from the interior shell surface and electrically connected by a first lead and a second lead extending respectively through the neck cavity region to an exterior of the shell. The lamp additionally includes an opaque ceramic shield positioned in the neck cavity intermediate the light source and the neck region having a first surface facing the light source and a second surface facing the neck region. The ceramic shield then blocks light into the neck region while thermally and electrically insulating the lamp and the associated lamp leads.

BEST MODE FOR CARRYING OUT THE INVENTION

Figure 1:
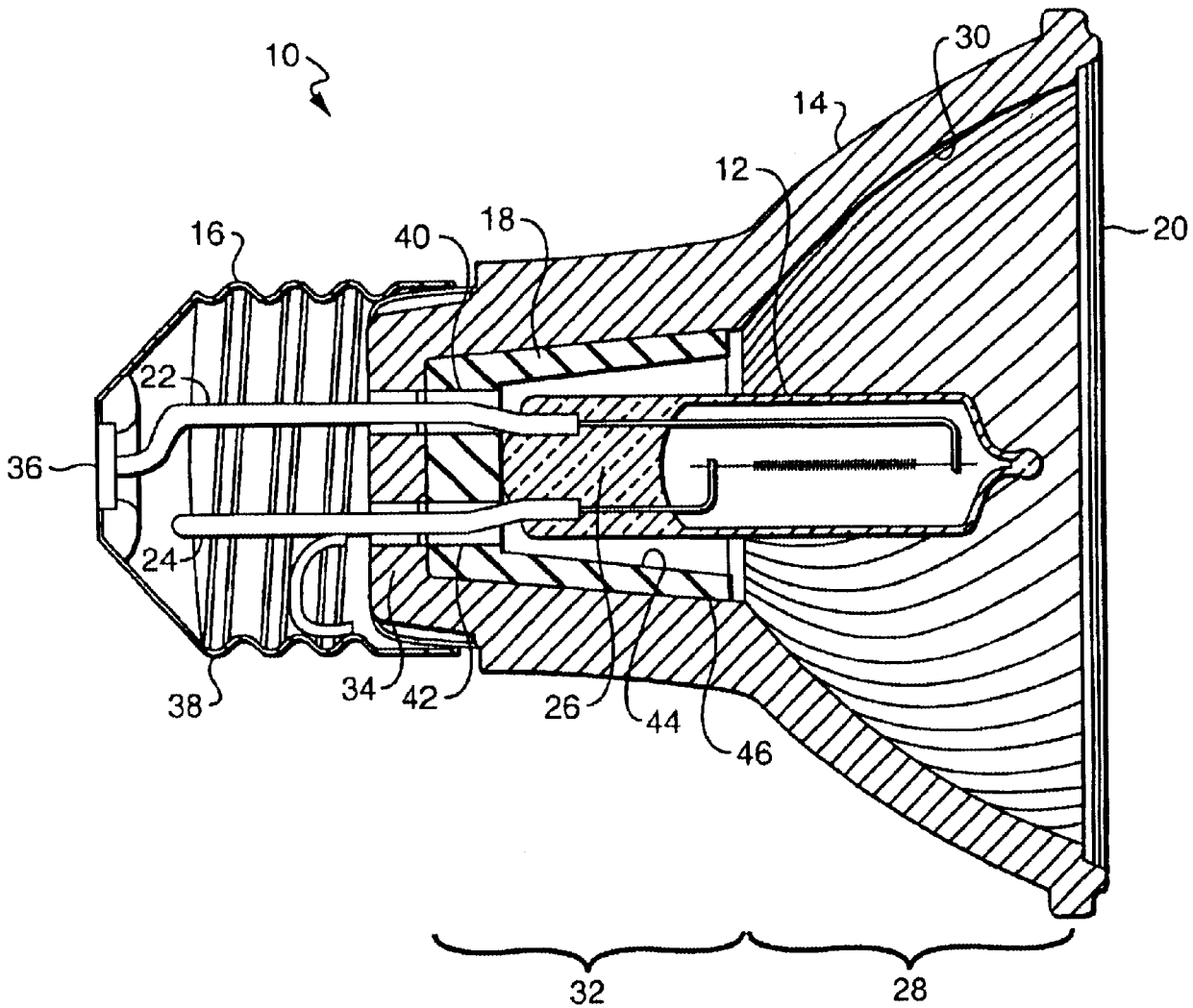
FIG. 1 shows a cross sectional view of a preferred reflector lamp.

FIG. 1 shows a cross sectional view of a preferred reflector lamp. The preferred reflector lamp 10 comprises a lamp capsule 12, a reflector 14, a base 16 and a ceramic shield 18. The reflector lamp 10 may optionally include a lens 20.

The lamp capsule 12 may be any small electric light source. The preferred lamp capsule 12 is a single ended, press-sealed tungsten halogen lamp. Tungsten halogen lamps are typically made from hard glass or quartz with a tubular shape. A first lead 22 and a second lead 24 extend from a press seal 26 and extend through the reflector 14 for electrical connection.

The preferred reflector 14 is a glass body of revolution defining a reflector region 28 with a reflective coating 30. The reflector may define a parabolic, elliptical or similar optically useful reflective surface. The reflective surface may be smooth, faceted, dimpled or have other features as is known in the art. The reflective coating 30 may be a metal coating of the interior surface defining the reflector region, such as an aluminum coating. The reflective coating 30 may alternatively be a dichroic coating of the same region. The reflector 14 extends from the reflector region 28 defining the reflector cavity to a neck region 32 defining a neck cavity. The lamp capsule 12 is positioned in the defined reflector cavity and neck cavity with the first lead 22 and the second lead 24 extending through the neck region 32 to the exterior of the reflector 14 for electrical connection. The neck region 32 may be closed by a base wall 34 that may include one or more through holes for the first lead 22 and the second lead 24. Formed on the exterior of the reflector 14 may be indentations, protuberances or similar features to which the base 16 may be attached. The preferred reflector 14 includes two indentations (not shown) formed on the exterior. The base wall 34 of the reflector 14 may include eyelets lining the holes to help position or align the lamp leads 22 and 24.

The base 16 may be any appropriate structure for holding the reflector 14 and adequately coupling the lamp 10 in a lamp socket. The preferred base 16 is a typical threaded metal base having a center contact 36 coupled to the first lead 22 and a conductive metal threading 38 coupled to the second lead 24. An edge of the preferred metal base is peened into the indentations formed in the exterior of the reflector 14 to hold the reflector 14 and the base 16 together firmly. Glues and other methods of attaching the reflector 14 to the base 16 are known in the art and may be used.

Figure 2:
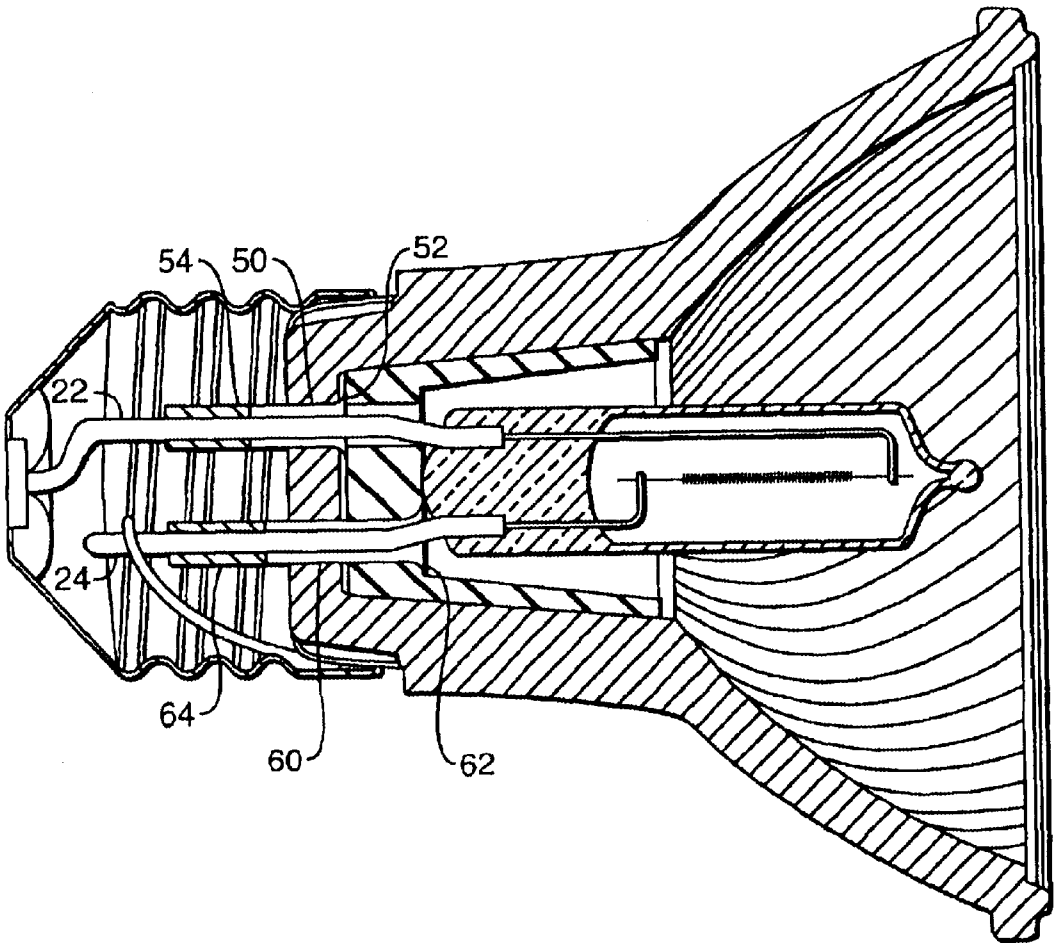
FIG. 2 shows a cross sectional view of a preferred alternative reflector lamp.

Positioned intermediate the lamp capsule 12 and the reflector neck region 32 is a ceramic shield 18. The preferred ceramic shield 18 is cup shaped to surround an end portion of the lamp capsule 12, for example the press seal region 26. The first lead 22 and the second lead 24 extend through a hole or holes 40, 42 (as shown) formed in the ceramic shield 18. The preferred cup is formed not to be light transmissive, and may further have a reflective interior surface 44. The ceramic cup may additionally, or alternatively include eyelets lining the cup holes 40, 42 to help position or align the first lead 22 and second lead 24. FIG. 2 shows a cross sectional view of a preferred alternative reflector lamp. A reflector passage 50 may be lined with an eyelet 52. A lead, such as lead 22 may be threaded through the eyelet 52, and then coupled to the eyelet 52 by crushing, crimping, soldering, swaging or by other means, the lead and eyelet, as known in the art, along their lengths 54. Alternatively, a passage 60 through the shield and reflector may be lined with an eyelet 62. A lead, such as lead 24 may be threaded through the eyelet 62, and then coupled to the eyelet 62 along their lengths 64. The eyelets 52 and 62 help align the lamp capsule 12 in the reflector 14.

The neck cavity and the exterior surface of the ceramic shield 18 may be formed to define an acceptably close fit between the two pieces. Some or the entire exterior surface 46 of the ceramic shield may then conformally fit with the adjacent interior of the reflector neck to brace the ceramic shield 18 in the reflector neck. Similarly, the interior of the ceramic shield may be formed to brace or conformally fit with the lamp capsule 12, the press seal 26 or the leads 22, 24. The ceramic shield 18 may then be pinned in the hollow of the neck region and locked by the penetrating leads 22, 24 between the lamp capsule 12 and the reflector 14. Alternatively, or additionally, a small quantity of a ceramic cement or high temperature epoxy may be positioned between the reflector 14 and the ceramic shield 18 to fill the gap between them and lock the ceramic shield 18 in place. A metal spring clip or other locking piece may also be used to couple the ceramic shield 18 in place.

The reflector lamp 10 may optionally include a lens 20. The lens 20 may seal with a forward rim portion of the reflector 14 to enclose the lamp capsule 12 in the reflector cavity.

The preferred assembly sequence of the lamp 10 is to insert the ceramic shield 18 in reflector neck, and then insert the lamp capsule 12 in the ceramic shield 18 and align the lamp capsule 12 relative to the reflector 14. In doing this, the capsule lead wires 22, 24 are fed through the holes in the ceramic shield 18 and then fed through the holes (and eyelets if any) in the bottom wall 34 of the reflector 14. After the leads 22, 24 are fed through the holes (or eyelets), the leads are then swaged, soldered, welded or otherwise sealed, just as if the light shield 18 was not included in the lamp structure. The base 16 is then peened in place to the reflector 14, and the leads 22, 24 connected to the base 16. Finally a lens 20, if any, is glued or otherwise attached in place.

The ceramic light shield may be metallized instead of glazed while maintaining the initially desired color. Pre-metallizing the ceramic shield is easier than metallizing the reflector neck interior. Glazing is easier still and less expensive than metallizing. One reason is that glazing can be included in the ordinary sintering process used in constructing the ceramic shield. Since the ceramic and glaze are insulators and do not interfere with the electrical conduction to the lamp capsule, there is greater flexibility in attaching the lamp reflector, base, lamp leads, or lamp capsule as the case may be. The preferred method of making the ceramic shield is to injection mold steatite. After initially sintering and cooling the ceramic shield green body, the ceramic shield 18 is dipped in or sprayed with a selected glaze. The ceramic shield is then finally sintered, which sets the ceramic density and size while also hardening the glaze.

PAR 20 reflectors may not have consistently good alignment of the lamp capsule with respect to the reflector due to how the leads pass through the base wall holes. The ceramic shield helps correct this. The ceramic shield can sit on top of the reflector eyelets that the capsule leads go through or the eyelets may be threaded into or through the ceramic shield. The lamp capsule leads may then be threaded through the reflector eyelets. In either case the leads are held closer to their preferred positions, meaning the lamp capsule is positioned in the reflector closer to its preferred (optically ideal) position. In still a further variation, the reflector may have a large single hole in the back for the leads. The ceramic shield may then be attached to the capsule leads by swaging to ceramic shield eyelets, if any. The ceramic shield and lamp assembly may be attached in the reflector with epoxy. In each case the eyelet may be swaged to the capsule leads. It is understood that the assembly steps may take place in alternative sequences, as may be convenient.

In one embodiment the reflector was made of glass with an interior dichroic coating to reflect visible light forward. The reflector had an exterior axial length of 52.76 millimeters, a reflector inside diameter of 53.31 millimeters and a neck inside diameter of 19.37 millimeters narrowing to a neck base diameter of 15.64 millimeters. The ceramic shield was cup shaped with a cup height of 21.42 millimeters and a cup outside diameter of 18.94 millimeters narrowing to 15.20 millimeters. The cup wall was about 1.12 millimeters thick. The interior of the cup was glazed with glass frit to give smooth reflective surface with an overall color of silver gray. The lamp capsule was a 50 watt, 120 volt tungsten halogen lamp with a tubular envelope 10 millimeters in diameter and an overall glass dimension of 38.71 millimeters. The single ended lamp capsule had two leads extending from the press seal that extended through the ceramic cup and the reflector to be electrically connected to a threaded brass base.

Photo tests show that there is a gain in the amount of useful light emitted through the front of the lamp. There is also a very large reduction in the stray light emitted out the back of the reflector. The preferred ceramic shield is glazed with a glaze color that looks from the outside like the color of the surrounding dichroic coating of the reflector. The ceramic shield additionally offers some light reflection back into the useful area.

The ceramic shield is much more effective than a metal shield. Three lamps were made according to this disclosure and were tested for total light output. The prototype lamps showed about 25–50 lumens more output than dichroic lamps that were otherwise similar but had no ceramic shield or metal shield. The tested lamps also showed practically no light emerging out of the back, which is highly undesirable in many applications. A significant advantage of ceramic shield is that the shield does not discolor the way metal can, thereby causing a loss in the amount of the light output by the lamp during its life.

The preferred ceramic shield is made of steatite ceramic, and can be less expensive than a metal shield. Both the metal and steatite shields have been tested. The ceramic shield has been found to be much more effective than a metal shield. Dichroic coated lamps and lamps with aluminized necks were also tested. They were found to be very nearly block light as well as the ceramic shield, but the cost of accurately coating the neck region is greater than the cost of the ceramic shield.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A reflector lamp comprising:

a) a light transmissive shell having a shell cavity with an interior surface extending from a reflector region that defines a reflector cavity to a neck region that defines a neck cavity;

b) a lamp capsule enclosing a light source, the lamp capsule positioned in the shell cavity and offset from the interior surface and electrically connected by a first lead and a second lead extending respectively through the neck cavity region to an exterior of the shell; and c) an opaque ceramic shield positioned in the neck cavity intermediate the light source and the neck region having a first surface facing, and offset from the light capsule and a second surface facing the neck region.

2. The reflector lamp in claim 1, wherein the reflector region is coated to reflect light from the light source to a field to be illuminated.

3. The reflector lamp in claim 2, wherein the reflector region has a dichroic coating reflecting visible light.

4. The reflector lamp in claim 1, wherein the shield includes one or more through passages and the first lead and the second lead pass through the shield.

5. The reflector lamp in claim 1, wherein the shield is cup shaped defining a cup cavity and a portion of the light source is located in the cup cavity.

6. The reflector lamp in claim 1, wherein the shield is electrically insulating.

7. The reflector lamp in claim 1, wherein an eyelet extends through the reflector and a lead extends through the eyelet.

8. The reflector lamp in claim 1, wherein an eyelet extends through the reflector and the light shield, and a lead extends through the eyelet.

9. A reflector lamp comprising:

a) a light transmissive shell having a shell cavity with an interior surface extending from a reflector region that defines a reflector cavity to a neck region that defines a neck cavity;

b) a light source positioned in the shell cavity and offset from the interior surface and electrically connected by a first lead and a second lead extending respectively through the neck cavity region to an exterior of the shell; and c) an opaque ceramic shield positioned in the neck cavity intermediate the light source and the neck region having a first surface facing, and offset from the light source and a second surface facing the neck region wherein the first surface is substantially light reflective.

10. A reflector lamp comprising:

a) a light transmissive shell having a shell cavity with an interior surface extending from a reflector region that defines a reflector cavity to a neck region that defines a neck cavity, the reflector region being coated to reflect light to a field to be illuminated;

b) a light capsule enclosing a light source, the light capsule positioned in the shell cavity and offset from the interior surface and electrically connected by a first lead and a second lead extending respectively through the neck cavity region to an exterior of the shell;

c) an opaque, electrically insulating, ceramic shield positioned in the neck cavity intermediate the light source and the neck region having a first surface facing the light source and a second surface facing the neck region, the shield being cup shaped defining a cup cavity and a portion of the light capsule is located in, and offset from the cup cavity and an eyelet extending through the reflector and the light shield, and one of the leads extends through the eyelet.

* * * * *